US005289153A

United States Patent [19]

Gross

[11] Patent Number: 5,289,153

[45] Date of Patent: Feb. 22, 1994

[54] SNAP TOGETHER, WRAP AROUND CORED COIL CLAMP

[75] Inventor: Robert S. Gross, Fort Wayne, Ind.

[73] Assignee: General Electric, New York, N.Y.

[21] Appl. No.: 907,275

[22] Filed: Jul. 1, 1992

[51] Int. Cl.[5] ..... H01F 27/28

[52] U.S. Cl. ..... 336/210

[58] Field of Search ..... 336/210, 197, 90

[56] References Cited

U.S. PATENT DOCUMENTS

| | | | |
|---|---|---|---|
| 1,524,591 | 1/1925 | Starr | 336/210 X |
| 1,579,955 | 4/1926 | Schermerhorn et al. | 336/210 X |
| 1,632,101 | 6/1927 | Thordarson | 336/210 X |
| 1,669,929 | 5/1928 | Currier | 336/210 |
| 1,974,588 | 9/1934 | Snell | 336/210 X |
| 2,148,449 | 2/1939 | Edwards | 336/210 X |
| 2,372,067 | 3/1945 | Forbes | 336/210 |
| 2,376,613 | 5/1945 | Nelson | 336/210 |
| 2,456,458 | 12/1948 | Somerville | 336/210 X |
| 2,494,350 | 1/1950 | Mittermaier | 336/210 |
| 3,374,453 | 3/1968 | Broverman et al. | 336/210 X |
| 3,662,308 | 5/1972 | Muschong | 336/210 |
| 3,668,586 | 6/1972 | Horbach | 336/210 |
| 4,155,061 | 5/1979 | Cook et al. | 336/210 X |
| 4,260,975 | 4/1981 | Wilcox et al. | 336/210 X |
| 4,596,974 | 6/1986 | Tobben et al. | 336/210 X |
| 4,723,349 | 2/1988 | Grimes | 336/210 X |
| 4,839,622 | 6/1989 | Hay | 336/210 X |
| 4,890,086 | 12/1989 | Hill | 336/210 |
| 5,194,841 | 3/1993 | Galloway et al. | 336/210 X |
| 5,198,790 | 3/1993 | Elow | 336/210 X |

FOREIGN PATENT DOCUMENTS

| | | | |
|---|---|---|---|
| 208879 | 9/1955 | Australia | 336/210 |
| 3325905 | 1/1985 | Fed. Rep. of Germany | 336/210 |
| 58713 | 4/1983 | Japan | 336/210 |
| 2129622 | 5/1984 | United Kingdom | 336/210 |

*Primary Examiner*—Leo P. Picard
*Assistant Examiner*—L. Thomas
*Attorney, Agent, or Firm*—Richard A. Menelly

[57] ABSTRACT

An electrical assembly including a coil assembly disposed around the central cross bar of a generally rectangular figure eight laminated core structure (10, 12) includes an upper clamp (14) that snaps into a lower clamp (16), the clamps provided with flanges (18–23) which completely cover the core (12), the clamps (14, 16) being snapped together and held in place by staked tabs (40) engaging slots (39). Mounting feet (29) and tabs to receive fasteners of auxiliary assemblies (33) are provided.

3 Claims, 1 Drawing Sheet

SNAP TOGETHER, WRAP AROUND CORED COIL CLAMP

BACKGROUND OF THE INVENTION

One form of typical transformer includes a squared figure eight core consisting of ferrous laminates with coils encircling the center cross bar of the core. Conventionally, laminations of the core, possibly including a cover which provides mounting feet, is secured together by fasteners (bolts, screws, rivets) which pass through clearance holes punched in the corners of the core laminations. The holes themselves reduce the magnetic flux paths which in turn causes increased core losses and requires increased excitation current. Furthermore, any metallic fasteners passing through the core must be provided with sleeves or spacers so as to insulate the fasteners from the core laminations, thereby to avoid electrical shorting of the laminations.

The use of such fastening devices generally involves a lengthy assembly time. In addition, excessive torque or pressure applied to the fasteners during the assembly process may draw laminations together too tightly and result in a breakdown of any insulative coating on the laminations. This results in the generation of eddy currents and commensurate further losses.

Conventional core clamp designs do not cover the entire core, which may leave sharp corners of the laminations exposed, making the transformers difficult to handle. Typically, the portion of the core not covered by the clamp is treated with varnish or paint to both inhibit and hide rusting of core laminations. However, the paint or varnish applied to the core or the clamp makes it difficult to establish a reliable electrical ground through the entire assembly.

The foregoing considerations apply also to similar cored coil electrical assemblies, such as inductors.

One purpose of the present invention is to provide a core clamp which facilitates quick assembly. Another purpose of the invention is to provide a core clamp which avoids the need for fasteners extending through the core laminations. A purpose of the invention is to provide a cored coil clamp which does not require excessive compression of the core laminations during assembly A further purpose of the invention is to provide a cored coil clamp which covers all of the exposed surfaces and corners of the core laminations.

SUMMARY OF THE INVENTION

The invention comprises a flanged bottom clamp having upwardly extending edge portions which receive a flanged top clamp, one of the clamps having a tab and the other of the clamps having a slot to receive the tab so as to snap-fasten the two clamps together; the clamp flanges cover the exposed surfaces and all four corners of the core laminations; tabs staked into the flanges allow mounting accessories such as terminal boards or fuse boards to the completed assembly.

DESCRIPTION OF THE PREFERRED EMBODIMENT

Figure 1:
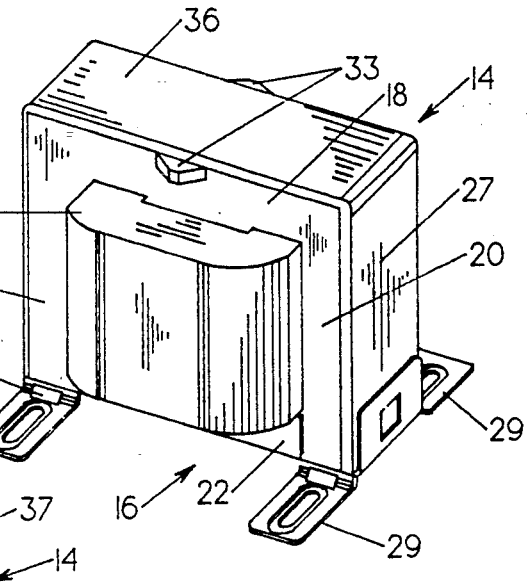
FIG. 1 is a perspective view of an embodiment of the invention completely assembled.
Figure 2:
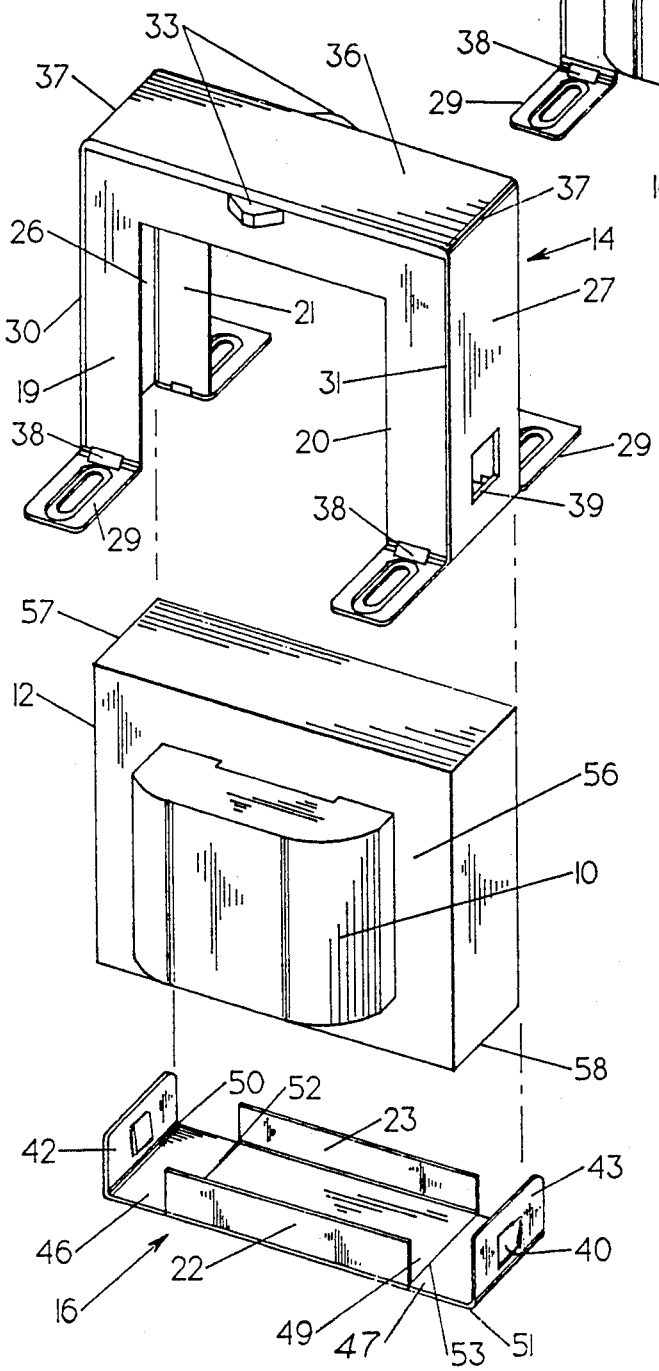
FIG. 2 is an exploded perspective view of the embodiment of FIG. 1.

Referring to the drawing, a cored coil assembly such as a transformer or an inductor comprises a coil winding 10 which surrounds the central cross bar of a rectangular figure eight core 12 which is made up of thin sheets of ferrous material (not distinctly shown). Electrical connection may be made to the coil assembly 10 in any conventional way, such as by terminal lugs or lead wires not shown. A top clamp 14 is adapted to snap inside of a bottom clamp 16 to thereby completely enclose the core 12. The top clamp 14 has three front flanges 18–20 and three rear flanges 21 (and two corresponding to the flanges 19, 20, not shown). The bottom clamp 16 has a front flange 22 and a rear flange 23. The flanges 19–21 are formed from end walls 26–27 and are extended to provide right-angle mounting feet. If desired, the bends 30, 31, between the flanges 19–20 and the end walls 26, 27 may be rounded so as to facilitate ease in handling. The flange 18 (and the flange opposite thereto) have closed tabs 33 staked therein to receive screws or the like to facilitate mounting accessory boards (such as terminal boards or fuse boards) to the completed assembly. The end walls 26, 27 are formed from a top wall 36 by suitable bends 37 which may be rounded. If desired, the mounting feet 29 may be staked as at 38, for additional strength.

The end walls 26, 27 are provided with holes or slots 39 to receive tabs 40 which are staked into end walls 42, 43 of the bottom clamp 16. The end walls are formed from extensions 46, 47 of a bottom wall 49 by suitably rounded corners 50, 51. The extensions 46, 47 are formed at corresponding bend lines 52, 53. The extensions 46, 47 are inclined at a slight downward angle so as to provide tension between the bottoms of the tabs 40 and the slots or holes 39 when the upper clamp 14 is snapped into the lower clamp 16. If found desirable or necessary, the end walls 42, 43 may also be provided at a slightly acute angle to the extensions 46, 47 so as to maintain a snug and secure fit when assembled.

The flanges 18–23 are suitably sized so as to completely cover the exposed surfaces such as the surface 56 of the core 12, as well as covering the sharp corners 57, 58 of the core 12.

Assembly is simply achieved by slipping the top cover 14 over the core and coil 10, 12 and then snapping the bottom clamp (clamp hereinbefore) over the top clamp, so that the tabs 40 engage the holes or slots 39. Note that once the assembly is mounted in place by fasteners through the mounting feet 29, the bottom clamp will be captured between the top clamp and the mounting surface to which it is secured.

Of course, if desired to suit any particular utilization of the present invention, the position of the mounting feet 29 and the end walls 42, 43 could be exchanged, providing four mounting holes or slots 39 on related flanges, and corresponding tabs 40 on front and rear walls depending upwardly from the extension 46, 47 at either end of the bottom clamp 16. This however might not be quite as sturdy as the embodiment shown.

There is provided a transformer or similar electrical assembly which is quickly snapped together and locked in place without any fasteners, thereby avoiding the need for clearance holes with sleeves or insulators to accommodate fasteners. Only minimal pressure is required so that core lamination insulation is not damaged. The wrap-around nature completely encapsulates the core, thus covering its sharp edges and avoiding the need to paint or varnish surfaces which may rust.

Having thus described my invention, what I claim as new and desire to secure by Letters Patent is:

1. An electrical assembly comprising:

a generally squared figure eight laminated core assembly having a coil assembly surrounding a central cross bar of said core assembly;

an upper clamp comprising a top wall having end walls extending generally perpendicular thereof, each of said end walls having front and rear flanges extending perpendicular therefrom, front and rear flanges of said end walls having mounting feet extending perpendicular therefrom, such that said mounting feet are in a plane which is generally parallel to the plane of said top wall, said end walls having slots formed therein at the distal ends thereof; and a bottom clamp having a bottom wall with front and rear flanges extending at right angles thereto and extensions of said bottom wall formed at a slight downward angle thereto, said extensions having end walls extending generally perpendicular thereto, the end-to-end length of said bottom wall being just slightly larger than the end-to-end length of said top wall of said upper clamp so that the end walls of said upper clamp will fit snugly within the end walls of said lower clamp, the end walls of said lower clamp having tabs staked therein, the bottoms of which extend inwardly of said end walls so as to engage said slots of said end walls of said upper clamp when said upper clamp is positioned within said lower clamp, the flanges of said lower clamp being sized to extend between edges of the flanges of one of the end walls of said upper clamp and the edges of the flanges of the other end wall of said upper clamp when said upper clamp is disposed within said lower clamp, said upper clamp fashioned to slip snugly over said core and coil assemblies, and fit snugly within the end walls of said lower clamp so that the lower edge of the tabs in said lower clamp engage the lower edge of a slots in said upper clamp, thereby to secure said clamps together and encapsulate said core.

2. The electrical assembly according to claim 1 wherein said end walls are both joined together and joined with said flanges by rounded corners.

3. The electrical assembly according to claim 1 wherein front and back flanges of the top wall of said upper clamp have closed tabs staked therein to receive fasteners to facilitate mounting accessory boards to said assembly.

* * * * *